United States Patent [19]

Riedel

[11] 3,964,760

[45] June 22, 1976

[54] SKI BRAKE

[75] Inventor: Tilo Riedel, Eching, Germany

[73] Assignee: S.A. Etablissements François Salomon & Fils, Annecy, France

[22] Filed: July 24, 1975

[21] Appl. No.: 598,628

Related U.S. Application Data

[63] Continuation-in-part of Ser. No. 557,476, March 12, 1975.

[30] Foreign Application Priority Data

July 26, 1974 Germany ..... 2436117

[52] U.S. Cl. ..... 280/605

[51] Int. Cl.[2] ..... A63C 7/10

[58] Field of Search ..... 280/11.13 B, 11.13 C, 280/11.13 Z, 11.35 C

[56] References Cited

UNITED STATES PATENTS

| | | | |
|---|---|---|---|
| 3,715,126 | 2/1973 | Schwarz | 280/11.13 B |
| 3,724,867 | 4/1973 | Hawthorne | 280/11.13 C |
| 3,884,487 | 5/1975 | Wehrli | 280/11.13 B |
| 3,899,185 | 8/1975 | Martin | 280/11.13 B |

FOREIGN PATENTS OR APPLICATIONS

| | | | |
|---|---|---|---|
| 134,042 | 7/1933 | Austria | 280/11.13 B |
| 349,911 | 12/1960 | Switzerland | 280/11.13 B |

*Primary Examiner*—M. H. Wood, Jr.
*Assistant Examiner*—David M. Mitchell
*Attorney, Agent, or Firm*—Karl F. Ross; Herbert Dubno

[57] ABSTRACT

A brake for a ski has a holder defining a pivot transverse to the ski and parallel to the upper surface thereof. A resiliently deformable wire has a central bight portion defining a plane, a pair of pivot portions confined in the holder pivot and bent inwardly toward each other out of the plane of the bight portion, a pair of connecting portions bent away from the pivot portions and extending outwardly away from each other toward the sides of the ski and a pair of leg portions extending generally parallel to each other from the connecting portions and lying out of the plane. The wire is symmetrical about a plane perpendicular to the surface and extending longitudinally of the ski. A braking element is carried on each of the leg portions, and is displaceable between a position in which it projects below the lower surface of the ski and a position in which it lies above this lower surface and within the lateral outline of the ski on displacement of the bight portion by the heel or toe of a skiboot.

9 Claims, 4 Drawing Figures

Fig. 2
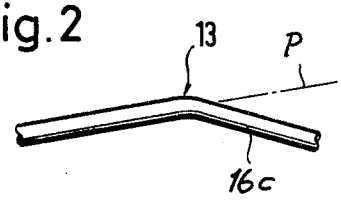
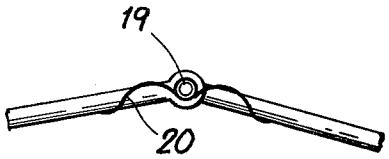
Fig. 3
Fig. 4
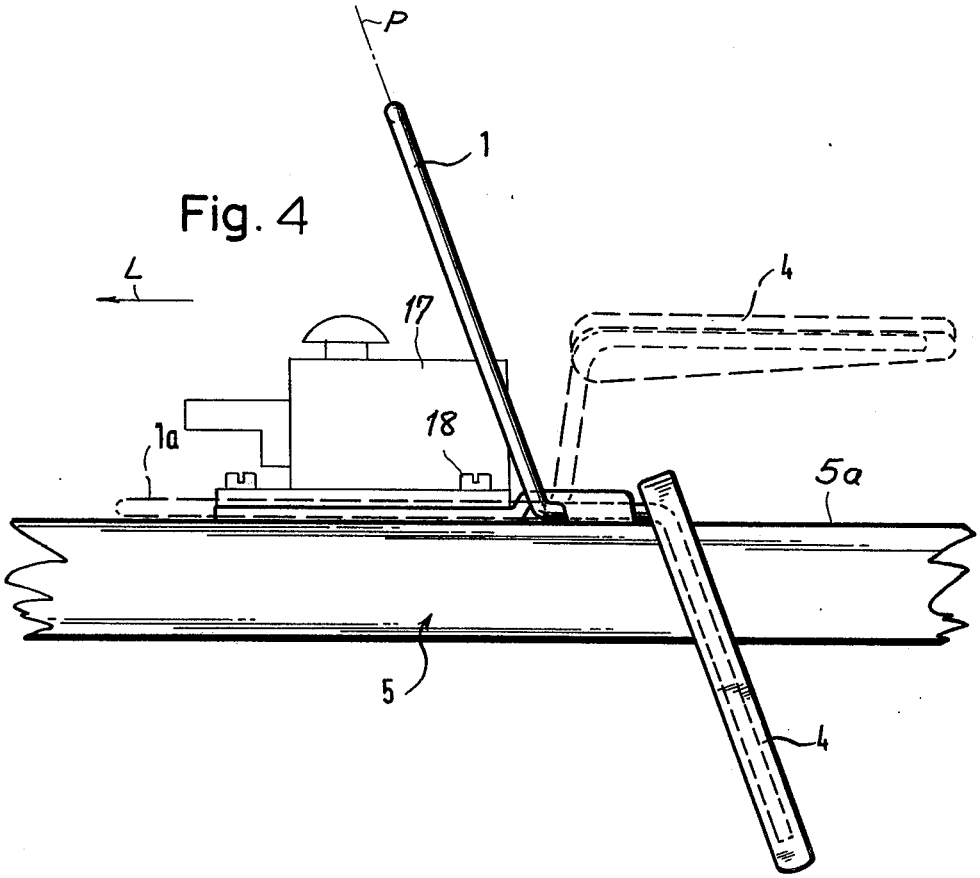

SKI BRAKE

CROSS-REFERENCE TO RELATED APPLICATION

This application is a continuation-in-part of my copending patent application Ser. No. 557,476 filed Mar. 12, 1975.

FIELD OF THE INVENTION

The present invention relates to an automatic ski brake and, more particularly, to a device for automatically stopping a ski when the skiboot is lifted away from the upper surface of the ski.

BACKGROUND OF THE INVENTION

An extremely dangerous situation is created if a ski is released from a boot. The free ski can go sliding down the ski slope, gathering considerable velocity and, if it hits someone, can produce serious injury. As a rule safety straps connect the skiboot of the skier to the ski binding, so that even if the skiboot is released from the binding a connection is maintained with the ski. Such a safety strap, however, is itself frequently pulled loose in a bad fall.

To this end so-called ski brakes have been developed which generally and most basically comprise a brake element, usually formed as a shovel, and means for swinging the brake element into an actuated position extending transverse to the ski and down beyond the lower face of the ski. Actuation of such a brake is automatic on displacement of the skiboot away from the ski so that the ski itself is automatically stopped, or at least prevented from moving at any appreciable rate of speed. This automatic actuation arrangement usually comprises at least one spring that is loaded as the skiboot is pressed down on the upper face of the ski.

In a typical arrangement the brake elements, formed as small shovels, are pivotal about an axle perpendicular to the longitudinal direction of the ski and spaced above the upper face of the ski behind the skiboot. A torsion spring wound around this axle loads the elements and a catch is provided for actuation as the boot is lifted off the ski to release the spring and cause the brake elements to pivot down from their position parallel to the ski into a position perpendicular to the ski and projecting below the lower face thereof.

A ski brake is also known which has a pair of leaf springs screwed to the ski toward the front and so constructed that their rear end portions normally stand up. The lateral edges are extended as shovel-like brake elements which project downwardly toward the ground when the spring is unstressed. When a skiboot is secured on top of these elements the brake elements are lifted and lie parallel to the edge of the ski. Such an arrangement has the significant disadvantage that these elements extending from the sides of the skis can become caught and cause injury to the skier or can catch on some object and become bent out of shape.

Most of these prior-art ski brakes not only have relatively complicated actuating mechanisms, but present the difficulty of often burdensome structure on the top face of the skis. Not only does this make donning the skis more difficult, but it considerably augments the cost of the skis. Furthermore this extra structure is failure prone in that if it catches on something like a root or the like it is damaged. Such complicated ski brakes are also known to ice up and become completely inoperative.

In my above-cited prior application I disclose a ski brake having support means secured to the ski and defining a pivot axis extending parallel to the upper face of the ski and at an acute angle to the longitudinal direction of the ski. A resiliently deformable wire has a pivot portion pivotal in the support means about this pivot axis and an actuation portion extending from and at an angle to the pivot portion and engageable by the skiboot to pivot the wire about its pivot portion. A brake element is carried on the wire and extends generally parallel to the actuation portion with this brake element therefore displaceable between an actuated position extending transverse to the upper face of the ski and beyond the lower face of the ski and an ineffective position extending generally parallel to the ski.

In accordance with this earlier invention the wire is at least partially U-shaped and has a pair of generally parallel legs constituting the actuation portion, each leg being provided with a respective such pivot portion rotatable about a respective pivot axis in the support means plate constituting the means secured to the ski. The wire carries a pair of such brake elements which are generally parallel to each other and lie on opposite sides of the ski, extending forwardly from the respective pivot portions and extending generally in the opposite direction from the ends of the legs.

My earlier application further disclosed the idea of forming the wire with the pivot portions extending generally toward one another. In this case the brake elements are carried on and extended generally in line with the legs.

The pivot portions in the system of my earlier application extend generally away from each other and have inner ends from which extend the legs' outer ends from which generally parallel end portions of the wire extend generally parallel to the actuation portions. The brake elements are carried on these end portions. Means is provided for displacing the pivot axes on displacement of the actuation portions from the actuated position to the ineffective position so as to decrease the angle they form with each other and thereby displace the brake elements toward each other. Thus as a skiboot comes down on the actuation portion of the arrangement it not only swings the brake up so that the elements lie parallel to the ski, but also pivots these elements inwardly so as to move them completely out of the way.

This is effected according to my earlier application by connecting the bight portion between the legs to a toggle having one end fixed relative to the ski and another end secured to the bight portion so that depression of the toggle toward the upper face of the ski pushes the bight portion back away from the pivot axes. The wire is generally planar in its actuated position and is stressed in its ineffective position. Thus the pivot portions extend at an angle to the plane of the wire in the actuated position in which the wire is substantially unstressed.

In accordance with yet another feature of my earlier application each brake element includes a back portion extending in line with the brake element back past the respective pivot portion. These back portions are engageable by a skiboot to displace the brake into its ineffective position.

OBJECTS OF THE INVENTION

It is an object of the present invention to advance the principles set forth in the above-cited patent application.

Another object is to provide an improved ski brake.

Yet another object is the provision of such a brake which is of very simple construction and which can be mounted both in the toe and heel region of the ski binding of the ski.

SUMMARY OF THE INVENTION

These objects are attained according to the present invention in a ski brake having a holder secured to the ski defining a pivot transverse to the ski and parallel to the upper surface thereof. A resiliently deformable wire has a central bight portion which defines a plane, a pair of pivot portions confined in the pivot of the holder and bent inwardly toward each other out of the plane. These pivot portions extend from the bight portion and a pair of connecting portions extend from and are bent away from the pivot portions. These connecting portions extend away from each other outwardly toward the sides of the ski and terminate in a pair of generally parallel leg portions which lie out of the plane of the bight portions. The wire is symmetrical about a symmetry plane perpendicular to the surface and longitudinal of the ski. A braking element is provided on each of the leg portions.

According to this invention the holder is formed of a plate having relatively thick front portion which constitutes a guide itself formed with passages that are the pivot for the pivot portions of the wire. These passages are slots in the face of the plate secured to the upper surface of the ski, which slots taper toward the outside edges of the skis and at these outside edges closely surround the wire passing through them. It is also possible in accordance with this invention to provide a secondary closure plate underneath the above-mentioned plate.

It also lies within the scope of this invention to form the bight portion with a region that is connected via a bend to the rest of the bight portion and which lies out of the bight portion plane. This arrangement insures that when the heel or toe of the skiboot is lifted off the bight portion this portion will spring up away from the surface of the ski and push the brake elements down below the lower surface thereof and into the snow.

BRIEF DESCRIPTION OF THE DRAWING

The above and other objects, features, and advantages will become more readily apparent from the following description, reference being made to the accompanying drawing in which:

FIGS. 2 and 3 are side views of details of other arrangements in accordance with the present invention; and FIG. 4 is a side view of the ski brake shown in FIG. 1.

SPECIFIC DESCRIPTION

Figure 1:
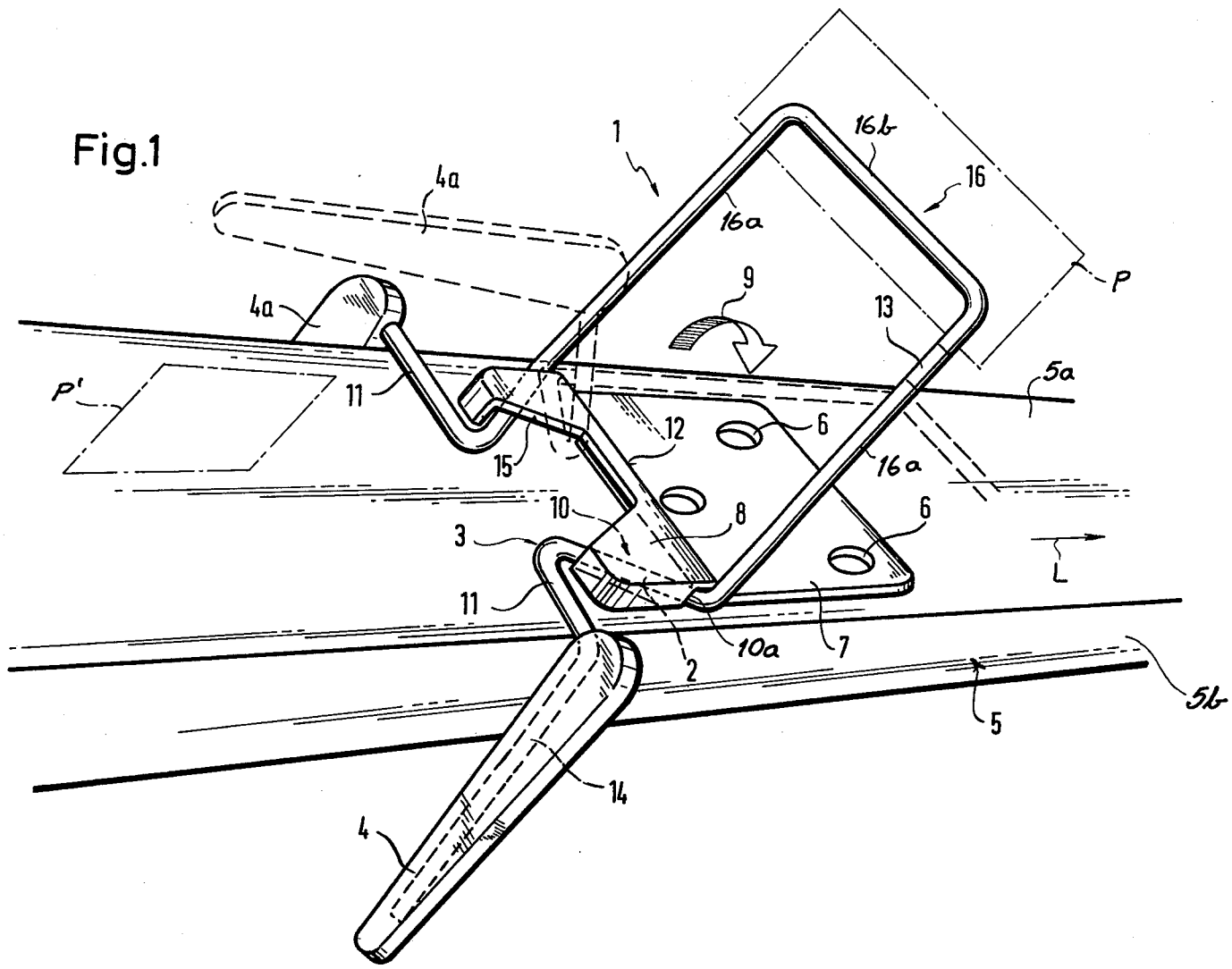
FIG. 1 is a perspective view of a ski brake according to this invention.

The ski brake according to the present invention as shown in FIGS. 1 and 4 has a wire 1 formed with a bight portion 16, a pair of pivot portions 2, and pair of connecting portions 11, and a pair of leg portions 14. The portions 2 are received in a holder having a rear portion 8 and a front portion 7, the latter being secured to the upper surface 5*a* of a ski 5 by means of screws through holes 6 in this portion 7.

The rear part 8 of the holder plate 7, 8 is formed with a pair of V-shaped notches 10 constituting passages tapering outwardly toward the sides 5*b* of the ski 5 and having opening holes 10*a* only slightly larger than the diameter of the round-section wire. The block is cut away between the two passages 10 and has inner edges 15 which lie at an angle of 45° to the longitudinal direction L of the ski 5. The portions 7 and 8 are separated from each other by a straight ledge 12. As shown in FIG. 4 a hydraulic heel clamp 17 may be secured by means of bolts 18 through the holes 6 over of the front section 7.

The bight portion 16 of the wire has a pair of generally parallel sides 16*a* and a bight 16*b* perpendicular to these sides and forming with them a plane P. The pivot portions 2 extend at an angle of between 30 and 60°, here 45° to the plane P in the unstressed condition of the wire 1. The connecting portions 11, which extend backwardly from elbows 3 formed between the portions 2 and the portions 11, are perpendicular to the longitudinal axis L of the ski and coaxially in line with one another. The leg portions 14 extend at right angles to these portions 11 and are parallel to each other as well as parallel to the plane P, but offset therefrom. The entire wire 1 is symmetrical about a plane P′ extending longitudinally of the ski 5 and perpendicular to the upper surface 5*a* thereof. This plane P′ bisects the bight 16*b*.

FIG. 2 shows how one or both of the sides of 16*a* of the bight 16 may be formed with a bend 13 so as to form a portion 16*c* that lies out of the plane P. This bend is deformable so that in use the entire leg 16*a* is straight and coplanar, but when unstressed it will insure that the bight portion 16 will lift up from the surface 5*a*. It is also possible as shown in FIG. 3 to provide a hinge 19 and torsion spring 20 at the region 13.

When unstressed the wire and the brake elements 4 assume the positions as shown in solid lines in FIGS. 1 and 2. That is the portions 11 and 2 lie flat against the upper surface 5*a* of the ski 5 and the bight portion 16 and the legs 4 extend parallel to each other and at an angle of 70° to this surface 5*a*.

When the bight portion 16 is depressed by the toe or heel of a skiboot, since this arrangement can be mounted at both the toe and heel, torsional deformation as indicated by arrow 9 of FIG. 1 occurs because of the configuration of passages 10 so as to twist the brake elements 4 up into the positions shown by dot-dash lines in FIGS. 1 and 4. In this position the brake elements 4 twist inside the outline defined by the side 5*b* of the ski so as to be effectively out of the way of the user and pose no danger to him or her.

During displacement between these two positions the pivot portions 2 are twisted within the tapering passages 10 so as to move from the backside to the front side, so as to give the above-mentioned twisting-in action.

I claim:

1. A brake for a ski adapted to be actuated by a skiboot, said brake comprising:

a holder secured to said ski and defining a pair of passages parallel to the upper surface of said ski;

a resiliently deformable wire having a central bight portion defining a plane, a pair of pivot portions respectively received in said passages and bent inwardly toward each other out of said plane from said bight portion, a pair of connecting portions bent away from said pivot portions and extending outwardly away from each other toward the sides of said ski, and a pair of leg portions extending generally parallel to each other from said connecting portions and lying out of said plane, said passages including an inner edge shaped to contact and guide said pivot portion to resiliently deform said wire and cause said leg portions to swing inwardly and upwardly upon depression of said bight portion by said skiboot, the resilient deformation of said wire causing the leg portions to swing outwardly and downwardly upon release of the bight portion by said skiboot; and a braking element on each of said leg portions, said holder being formed with a pair of slots which taper toward the outside edge of said ski and each constituting one of said passages.

2. The brake defined in claim 2 wherein said holder is formed with a pair of slots open toward and closed by said surface and each constituting a one of said passages.

3. The brake defined in claim 1 wherein said holder has a relatively thick rear portion formed with said pivot and a relatively thin front portion adapted to receive a ski-binding heel clamp, said portions being integral and separated by a ledge.

4. The brake defined in claim 1 wherein said bight portion has a region bent out of said plane and a bend connecting said region to said bight portion.

5. The brake defined in claim 4 wherein said wire is provided at said bend with resilient means for normally urging said region into a position bent away from said plane of said bight portion and toward said upper surface.

6. The brake defined in claim 4, further comprising a hinge at said bend.

7. The brake defined in claim 1 wherein said pivot portions are bent inwardly from said bight portion and lie in an unstressed condition of said wire at an angle to said plane and to a plane perpendicular thereto, said wire being stressed when subjected to the said resilient deformation.

8. The brake defined in claim 7 wherein said connecting portions are straight and generally coaxial.

9. A brake for a ski adapted to be actuated by a skiboot, said brake comprising:

a holder secured to said ski and defining a pair of passages parallel to the upper surface of said ski;

a resiliently deformable wire having a central bight portion defining a plane, a pair of pivot portions respectively received in said passages and bent inwardly toward each other out of said plane from said bight portion, a pair of connecting portions bent away from said pivot portions and extending outwardly away from each other toward the sides of said ski, and a pair of leg portions extending generally parallel to each other from said connecting portions and lying out of said plane, said passages including an inner edge shaped to contact and guide said pivot portion to resiliently deform said wire and cause said leg portions to swing inwardly and upwardly upon depression of said bight portion by said skiboot, the resilient deformation of said wire causing the leg portions to swing outwardly and downwardly upon release of the bight portion by said skiboot; and a braking element on each of said leg portions, said holder being formed with a pair of slots and each constituting one of said passages, each passage tapering toward the respective ski edge and has at its outer end a cross-sectional area slightly greater than the cross-sectional area of said wire at said end.

* * * * *